United States Patent [19]

Marforio

[11] 4,073,248

[45] Feb. 14, 1978

[54] UPPER ROLLER FEED MECHANISM FOR A SEWING MACHINE

[75] Inventor: Nerino Marforio, Milan, Italy

[73] Assignee: Rockwell-Rimoldi, S.p.A., Milan, Italy

[21] Appl. No.: 727,878

[22] Filed: Sept. 29, 1976

[30] Foreign Application Priority Data

Oct. 2, 1975 Italy ..... 27870/75

[51] Int. Cl.[2] ..... D05B 27/06; D05B 27/10

[52] U.S. Cl. ..... 112/207; 112/212; 112/214; 112/237

[58] Field of Search ..... 112/214, 211, 203, 212, 112/237, 207

[56] References Cited

U.S. PATENT DOCUMENTS

| | | | |
|---|---|---|---|
| 1,368,293 | 2/1921 | Ringe | 112/214 |
| 1,736,297 | 11/1929 | Weis | 112/214 |
| 2,678,010 | 5/1954 | Pinkvoss | 112/214 |

FOREIGN PATENT DOCUMENTS

| | | | |
|---|---|---|---|
| 936,946 | 9/1967 | United Kingdom | 112/214 |

*Primary Examiner*—H. Hampton Hunter

[57] ABSTRACT

An improved upper roller feeding mechanism for a sewing machine which mechanism is contained entirely within the head of the frame of the sewing machine and wherein the roller is driven by a drive mechanism supported by the frame which includes a rotary shaft and means for converting the rotating movement of the shaft into an oscillating movement. A one way clutch is utilized to translate the oscillating motion into incremental rotary movement which is in turn transmitted to the roller.

1 Claim, 3 Drawing Figures

UPPER ROLLER FEED MECHANISM FORA SEWING MACHINE

BACKGROUND OF THE INVENTION

The present invention relates to an upper roller feeding mechanism for a sewing machine and more particularly to an upper roller feeding mechanism mounted on the machine in operative association with the well known type of feed dog mechanism disposed beneath the machine's presser foot.

Conventional sewing machines which utilize an upper feeding mechanism have a roller that is supported by the machine's presser mechanism and is driven intermittently by a plurality of operatively connected elements which includes a drive chain for effecting actuation of said roller. The mechanism requires, what is considered, an excessive amount of space to perform its intended function due to the fact that some of the elements are housed within the frame of the machine and others are mounted on the outer surface thereof.

Additionally, the drive chain which is adapted to actuate the roller is rather long which creates a problem of back lash that is effective in causing a delay in the intended movement of the upper feeding mechanism relative to the lower one.

During the stitching operation of joining two or more layers of fabric such a delay will cause relative sliding or slipping between the layers and as intended said layers will not be displaced simultaneously by the stitching instrumentalities.

Due to the fact that many of the elements of the drive are disposed on the outer surface of the sewing machine frame, a serious problem presents itself of providing the necessary amount of lubricant for each of said elements.

An object of the present invention is to eliminate the problems described above with known types of drives by providing a drive for the upper feed roller which requires substantially less space in the sewing machine and in which the various components thereof are arranged so as to simplify their lubrication.

SUMMARY OF THE INVENTION

The technical problem to be solved in order to achieve this aim is that of providing a drive within the head of the frame that it is located in close proximity with the roller of the upper feeding mechanism and which is totally enclosed so that the problem of lubrication of the various parts thereof is eliminated. The solution to this technical problem according to the invention includes an upper feeding mechanism of the aforementioned type which is disposed in operative association with a conventional lower feed dog mechanism. A presser mechanism including the usual presser bar operatively mounted in the head of the frame of the sewing machine is adapted to support the upper feed roller. The roller is driven by a drive mechanism supported by the frame which includes a rotating shaft with means for converting the rotating movement of said shaft into an oscillating movement. A one way clutch changes this oscillating movement into incremental rotary movement which in turn is transmitted to the roller. A lifting mechanism is proveded for raising the roller simultaneously with the raising of the presser bar and being contained within the head of the machine it includes an element that is mounted on the presser bar and which oscillates about the same and connects the means for converting the rotational movement into an oscillating movement with the one way clutch which is also carried within the head of the sewing machine.

These and other features will be made apparent in the course of the following description of a preferred but not exclusive embodiment of the invention which is provided with reference to the accompanying drawings in which:

DESCRIPTION OF THE PREFERRED EMBODIMENT

Figure 1:
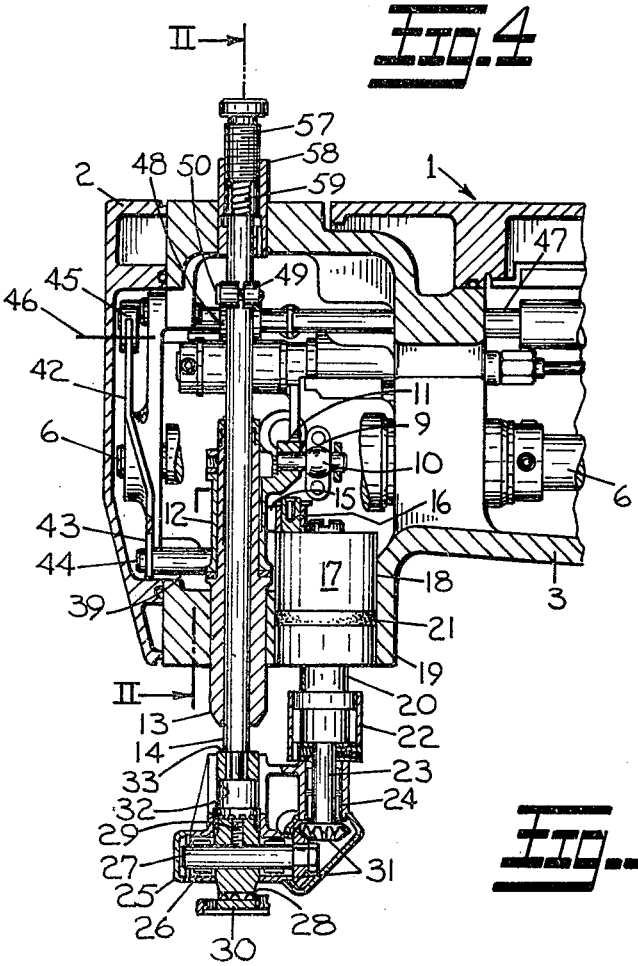
FIG. 1 is a view in side elevation and partially in section of the head portion of a sewing machine showing the upper roller feeding mechanism according to the present invention applied thereto.
Figure 3:
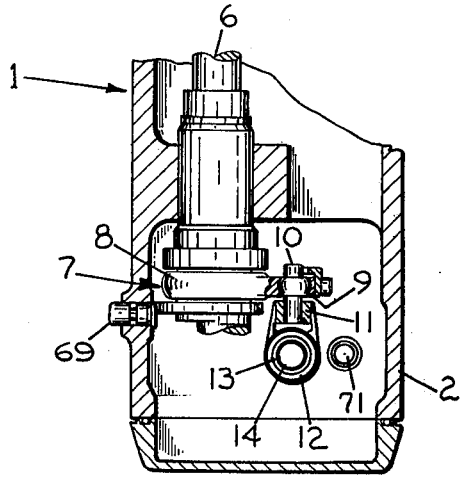
FIG. 3 is a sectional view of a sewing machine taken along line III—III in FIG. 2.
Figure 2:
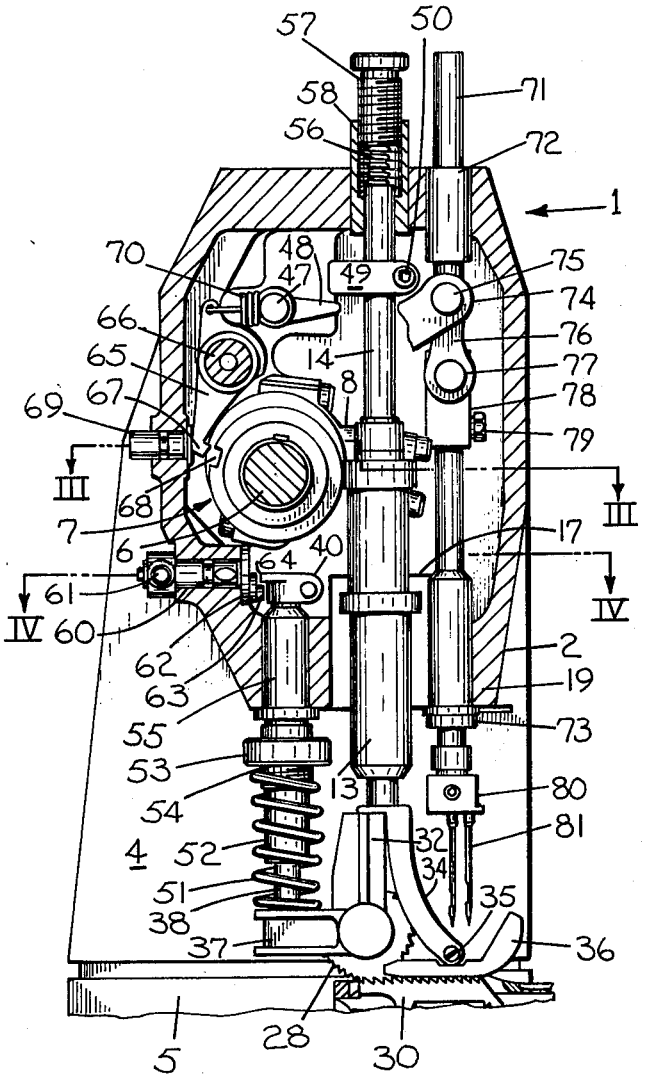
FIG. 2 is a sectional view taken along line II—II in FIG. 1.

Referring now to FIGS. 1 and 2 a portion of a frame 1 is shown which includes a head 2 that forms one end of an arm 3 that extends from the upper end of a vertically disposed support member 4. The lower end of this support member 4 is fixed to the base of the sewing machine which is identified by numeral 5.

The arm 3 houses, inter alia, a rotatably driven shaft 6 which extends through the arm 3 with one end thereof being connected to a drive motor (not shown) and the opposite end being located within the head 2.

An eccentric 7 having adjustable eccentricity is fixed on the shaft 6. The eccentric 7 is connected to a rod 8 which includes a foot 9 that is connected to a spherical headed pin 10 one end of which is disposed within the bifurcation of a fork 11 that is fixed on a sleeve element 12. This sleeve element is mounted on a guide bushing 13 within which a presser bar 14 is slidable and provides a means for permitting oscillating movement of said sleeve element.

Figure 4:
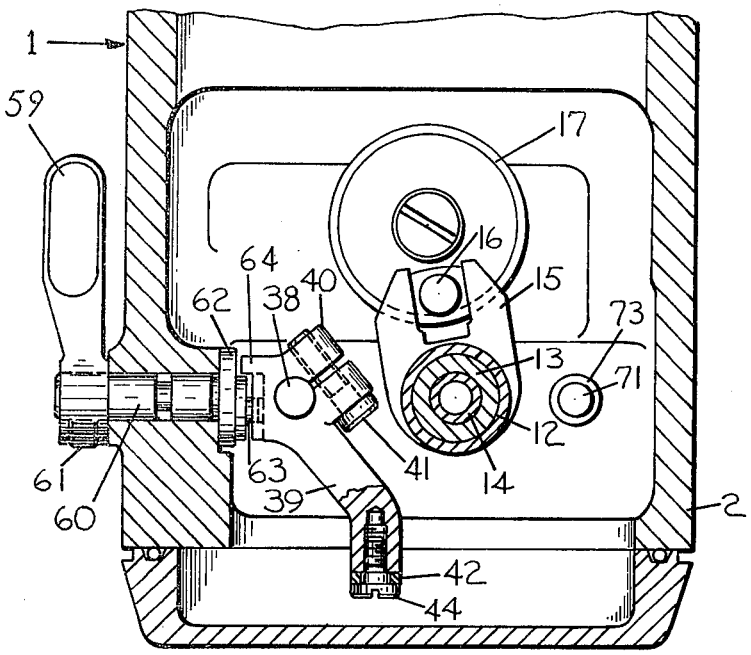
FIG. 4 is a sectional view taken along line IV—IV in FIG. 2.

The sleeve 12 also carries another forked member 15 (FIG. 4) which is engaged by a pin 16 of a conventional one way clutch 17. The one way clutch is assembled in a seat 18 assembled in the lower surface 19 of the head 2 and includes a clutch guide shaft 20 which extends downwardly beyond said lower surface.

The one way clutch is adapted to convert the oscillating movement of the sleeve element 12 into intermittent rotary movement and to transmit this movement to the guide shaft 20.

A lubricant washer 21 is provided between the seat 18 and the one way clutch 17.

The guide shaft 20 is connected by means of a telescopic joint 22 to a shaft 23 which is rotatably mounted by means of bearings 24 in a support member 25 (FIG. 1).

The support member 25 also includes a shaft 27 that is rotatably mounted by means of the bearings 26 and has a roller 28 fixed on said shaft 27 by means of a screw 29.

The roller 28 forms the upper feeding mechanism which operatively cooperates with the lower feed dog mechanism identified by numeral 30.

The shaft 23 and the shaft 27 are interconnected by means of a pair of bevel gears 31 that are adapted to transmit the intermittent rotary movement of the guide shaft 20 to the roller 28 of the upper feeding mechanism.

The support member 25 is provided with two guide elements 32 that are attached to a block 33 which forms an integral part of the clamp 34 to which the presser foot 36 is pivotably attached as at 35.

The support member 25, is capable of sliding movement in a vertical direction with respect to the block 33 and includes a projection 37, FIG. 2, to which one end of a rod 38 is fixedly attached. The opposite end of rod 38 has an arm 39 (FIG. 4) fixed thereon by means of an integrally formed split collar 40 in said arm which includes a tightening screw 41.

One end of the arm 39 is attached to a connecting rod 42 which includes a slot 43 through which a screw 44 carried by the arm 39 extends and which is slidable within the limits of the slot 43.

The connecting rod 42 is pivotally attached to a lever 45 along the axis 46. The lever 45 is keyed on a shaft 47 which extends through the arm 3 and is connected to a control means such as a treadle (not shown).

A lever 48 also keyed to shaft 47 and adapted to cooperate with an arm 49 is connected by means of a split collar and screw 50 to the presser bar 14 for the purpose of raising the latter.

The roller 28 is biased in a downwardly direction by a spring 51 that is supported on a lower sleeve 52 which is located between the projection 37 and a ring 53 assembled onto a threaded portion 54 of the sleeve 52 and within which the rod 38 is adapted to slide.

The rod 38 is also guided in an upper sleeve 55 that is assembled in the lower surface 19 of the head 2.

The pressure of the spring 51 and thus of the roller 28 can be regulated by selectively rotating the ring 53.

The presser bar 14 is continually urged downwardly by a spring 56 disposed between the upper part of said presser bar and a regulating screw 57 assembled in an internally threaded sleeve 58 which is carried in the upper surface of the head 2. The pressure of the spring 56, and thus of the presser foot can be adjusted by selectively rotating the screw 57.

When the shaft 47 is rotated, the presser foot 36 and the roller 28 are simultaneously raised.

A lever 59 disposed adjacent the outer surface of the head 2 and attached to a relatively short shaft 60 by means of a screw 61 is provided for the purpose of raising the roller 28 independently of the presser foot.

The shaft 60 is provided with a plate 62 which carries a lug 63 that is disposed eccentrically of the axis of said shaft 60.

The lug 63 is rotatable with the plate 62 by means of the lever 59 and is adapted to engage a projection 64 on the arm 39 so as to raise the rod 38 and the roller 28 operatively connected to the lower end thereof.

The roller 28 can be raised independently due to the fact that the slot 43 of the connecting rod 42 permits the arm 39 to be moved upwardly by the lever 59 without affecting the shaft 47 and the presser bar 14.

The eccentric 7 is provided to regulate the amplitude of the intermittent rotary movements of the roller 28. The eccentricity of the eccentric 7 is regulatable by means of a lever 65 which is pivotably attached at 66 and which is provided with a tooth 67 that is adapted to penetrate a recess 68 in the eccentric 7.

Insertion of the tooth 67 into the recess 68 is accomplished by means of a push button 69 which protrudes from the head 2 of the machine against the force of a spring 70 one end of which is attached to the lever 65 and the other of which is connected to the shaft 47.

The eccentricity of the eccentric 7 can be regulated in a known manner by maintaining the push button 69 depressed while rotating the shaft 6 by means of the conventional hand wheel (not shown) until the tooth 67 enters into the recess 68. By continued rotation of the shaft 6 the desired eccentricity can be obtained and the desired amount can be controlled by graduated markings provided on the hand wheel.

The needle bar 71 is also housed in the head 2 and is slidably within two spaced sleeves 72 and 73 carried by the head per se.

The rotary movement of the shaft 6 is transmitted to the needle bar 71 by known drive means which in FIG. 2 show only the end of a lever 74 pivotably connected at 75 to a link 76 which in turn is pivotably attached at 77 to a clamp 78 that is attached to the needle bar 71 by means of a screw 79.

The needles 81 are carried on the lower end of the needle bar 71 by means of a needle clamp 80. The needles 81 during the performance of their intended function cooperate with the lower feed dog mechanism 30, with the upper roller feed mechanism 28 and with the other stitch forming mechanisms (not shown) in a known manner. The eccentric 7, the rod 8, the sleeve 12 and the one way clutch 17 which form the driving mechanism for converting the rotational movement of the shaft 6 into intermittent rotary movement of the shafts 20, and 47, the lever 45, the connecting bar 42, and the arm 39 forming the drive means for raising the roller 28 are suitably lubricated in a conventional manner (not shown).

This lubrication can be carried out in the optimum manner owing to the fact that the driving elements of the mechanism are all enclosed within the head 2 of the sewing machine.

Although the present invention has been described in connection with a preferred embodiment, it is to be understood that modifications and variations may be resorted to without departing from the spirit and scope of the invention and the appended claims.

What is claimed is:

1. An upper roller feed mechanism for sewing machines of the type including a lower feed mechanism operatively associated with an upper feed mechanism with a presser mechanism having a presser bar mounted in the head of the machine for positioning an upper feed roller adjacent said machine's presser foot, the improvement comprising:

(a) a rotatably driven shaft (6) supported within the sewing machine;

(b) an eccentric (7) mounted on said shaft (6) having a rod (8) fixed thereto for converting rotary movement of said shaft to oscillating movement;

(c) means defining a one-way clutch (17) interconnecting the upper feed roller (28) with said rod (8) for changing the oscillating movement of the latter to effect incremental unidirectional rotary movement of said roller;

(d) lifting means within the head for raising the feed roller (28) with the presser bar which includes:

(i) a selectively rotatable shaft (47) having a lever (48) fixed thereon in operative association with an arm (49) fixed on the presser bar;

(ii) a depending rod (42) pivotably attached at one end to said shaft (47) and interconnecting the latter with an arm (39) on a rod (38); and (iii) a roller support (25) attached to said rod (38) for effecting simultaneous vertical movement thereof with the presser bar upon selective rotation of said shaft (47).

* * * * *